US005832339A

United States Patent [19]

Inui et al.

[11] Patent Number: 5,832,339

[45] Date of Patent: Nov. 3, 1998

[54] IMAGE FORMING APPARATUS CAPABLE OF READILY AND CONVENIENTLY SETTING AN OPERATING CONDITION

[75] Inventors: Kazuo Inui, Toyohashi; Hiroshi Yamada, Toyokawa; Junko Natsume, Aichi-ken, all of Japan

[73] Assignee: Minolta Co., Ltd., Osaka, Japan

[21] Appl. No.: 942,934

[22] Filed: Oct. 2, 1997

[30] Foreign Application Priority Data

Mar. 10, 1997 [JP] Japan ..... 9-054958

[51] Int. Cl.[6] ..... G03G 15/00

[52] U.S. Cl. ..... 399/83; 399/1; 399/81

[58] Field of Search ..... 399/79, 80, 81, 399/1, 10, 83; 358/296, 300

[56] References Cited

U.S. PATENT DOCUMENTS

| | | | |
|---|---|---|---|
| 5,027,153 | 6/1991 | Komiya | 399/79 |
| 5,041,873 | 8/1991 | Kawabuchi et al. | 399/83 |
| 5,260,742 | 11/1993 | Kikkawa | 399/83 |
| 5,278,611 | 1/1994 | Ito et al. | 399/83 |
| 5,293,197 | 3/1994 | Iwao | 399/83 |
| 5,325,152 | 6/1994 | Higashio et al. | 399/83 |

FOREIGN PATENT DOCUMENTS 07-076155 3/1995 Japan .

*Primary Examiner*—S. Lee
*Attorney, Agent, or Firm*—Sidley & Austin

[57] ABSTRACT

A copying machine is provided capable of readily and conveniently setting a User's Choice value for an additionally set division. In the copying machine, the User's Choice value of the system which is set for each division is stored in a rewritable storage, such as a hard disc, a back-up memory or the like. The User's Choice of the system is changed in a control unit of the copying machine. The User's Choice value of the system is used as default in registering a new division, and it is thus not necessary to conventionally set a new User's Choice value based on the User's Choice value of the system which is stored in a ROM and thus cannot be changed. Thus, setting User's Choice values is no longer cumbersome for users, and the users can readily and conveniently set User's Choice values for an additionally set divisions.

14 Claims, 16 Drawing Sheets

FIG.12A

| OPTION | FUNCTION |
|---|---|
| ORIG. → COPY PRIORITY | SETTING PRIORITY AS TO ORIG. → COPY MODE |
| LANGUAGE SELECTED | SETTING OF A LANGUAGE FOR DISPLAYING A MESSAGE |
| ORG. MIXED | SETTING PRIORITY AS TO WHETHER OR NOT ORIGINALS ARE MIXED |
| JOB RECALL | SETTING AS TO WHETHER OR NOT IMAGE DATA ACCESS IS ALLOWED AFTER THE LAST SHEET IS DISCHARGED |
| AUTO PRIORITY | SETTING PRIORITY AMONG AUTOPAPER/AUTOZOOM/MANUAL |
| SHEET PRIORITY | SETTING PRIORITY AS TO SHEET FEEDING SOURCE |

FIG.12B

ORIG. → COPY PRIORITY

| DESCRIPTION | INITIAL VALUE |
|---|---|
| ONE SIDE → ONE SIDE | ○ |
| ONE SIDE → BOTH SIDES | |
| BOTH SIDES → BOTH SIDES | |

FIG.12C

LANGUAGE SELECTED

| LANGUAGE AVAILABLE | INITIAL VALUE |
|---|---|
| JAPANESE/ENGLISH/GERMAN/ENGLISH/FRENCH/ DUTCH/ITALIAN/SPANISH/ PORTUGUESE/DANISH/NORWEGIAN/SWEDISH/ | JAPANESE |

FIG.12D

ORIGINALS MIXED

| DESCRIPTION | INITIAL VALUE |
|---|---|
| ORIGINALS ARE MIXED | |
| ORIGINALS ARE NOT MIXED | ○ |

FIG.12E

JOB RECALL

| DESCRIPTION | INITIAL VALUE |
|---|---|
| RECALL IS ALLOWED | |
| RECALL IS NOT ALLOWED | ○ |

FIG.12F

AUTO PRIORITY

| DESCRIPTION | INITIAL VALUE |
|---|---|
| AUTO SHEET | ○ |
| AUTO ZOOM | |
| MANUAL | |

FIG.12G

AUTO PAPER

| DESCRIPTION | INITIAL VALUE |
|---|---|
| 1ST DRAWER | ○ |
| 2ND DRAWER | |
| 3RD DRAWER | |
| 4TH DRAWER | |
| 5TH DRAWER | |

- THE PRIORITIZED SHEET SIZE AND SHEET FEEDING SOURCE ARE SIMULTANEOUSLY SET.
- THE SHEET FEEDING SOURCE CONNECTED IS ONLY DISPLAYED.

DISPLAYED IN JAPANESE

DISPLAYED IN ENGLISH

IMAGE FORMING APPARATUS CAPABLE OF READILY AND CONVENIENTLY SETTING AN OPERATING CONDITION

BACKGROUND OF THE INVENTION

1. Field of the Invention

The present invention relates to an image forming apparatus, and particularly to an image forming apparatus in which one of a predetermined number of stored operating conditions is selected and an image is formed according to the selected operating condition.

2. Description of the Related Art

Conventionally, an image forming apparatus capable of setting a plurality of operating conditions has been known. The plurality of operating conditions are set, for example, for each division of an organization, and the data of the operating conditions for each division are stored in a back-up memory, a hard disc or the like. Operating conditions which are set in an image forming apparatus (also referred to as User's Choice hereinafter) include various functions, such as the initial value for the copy mode and languages used in the display device, and these operating conditions can be customized for each division to conveniently use the image forming apparatus.

The default data for such a User's Choice is stored in a ROM (Read Only Memory). When a new division is to be added, the default data for the User's Choice stored in the ROM is set as the data of the User's Choice for the new division.

An image forming apparatus is also known capable of using a common User's Choice which is set independently of the setting for each division as the User's Choice until a division is designated. The data for this common User's Choice as well as the User's Choice for each division is stored in a rewritable memory device, such as a back-up memory and a hard disc.

In such a conventional image forming apparatus as described above, however, the setting of all of the data need be confirmed even when part of the common User's Choice need only be changed to add a new division, since the data stored in the ROM is used as the default User's Choice data.

Furthermore, if use of the values of the default User's Choice data caused a problem in using the image forming apparatus at a newly added division, the values of the data for the User's Choice need be changed. However, when such a User's Choice to be changed includes language for display on the display panel of the image forming apparatus, for example, users who cannot understand the language set as default cannot make a change between languages.

SUMMARY OF THE INVENTION

Therefore one object of the present invention contemplates an image forming apparatus capable of readily and conveniently setting an operating condition.

Another object of the present invention is to readily set the initial operating environment in an image forming apparatus.

Still another object of the present invention is to readily set an operating environment for a new division in setting an operating environment for each division.

The above objects of the present invention are achieved by an image forming apparatus including: an image forming device for forming an image in a plurality of operating environments; a first storage device for storing information on a user; a first input device for inputting information on a user; a second storage device for storing an initial operating environment and an operating environment corresponding to the information on the user stored in the first storage device; a device for changing an operating environment stored in the second storage device; a second input device for inputting a change of an operating environment to the device for changing; a device for specifying a user according to an input from the first input device and to the information on the user stored in the second storage device; and a device for setting the initial operating environment as an operating environment for the image forming device when a result obtained by the device for specifying is as predetermined.

A user is specified according to information on a user and to a plurality of operating environments corresponding to information on a user, and according to the result, an initial operating environment is set as an operating environment for the image forming device. Since an operating environment for the image forming device corresponding to a user is set based on the information on the user, an image forming apparatus capable of readily and conveniently setting an operating condition can be obtained.

Preferably, common divisional information shared by a plurality of users and personal information on an individual user are input through the first input device.

Information on a user includes the common divisional information shared by a plurality of users and the personal information on the individual user and thus an operating environment for the image forming apparatus can readily be set for each division.

Still preferably, the first input device accepts an input on an operation panel provided in the image forming apparatus. Since information on a user is accepted on the operation panel of the image forming apparatus, the user can set an operating environment for the image forming apparatus on the operation panel. Thus, an operating environment for the image forming apparatus can be set without any cumbersome procedures.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 12A–12G show examples of functions which can be set through User's Choice.

DESCRIPTION OF THE PREFERRED EMBODIMENTS

A copying machine as one embodiment of the present invention will now be described with reference to the figures.

Figure 1:
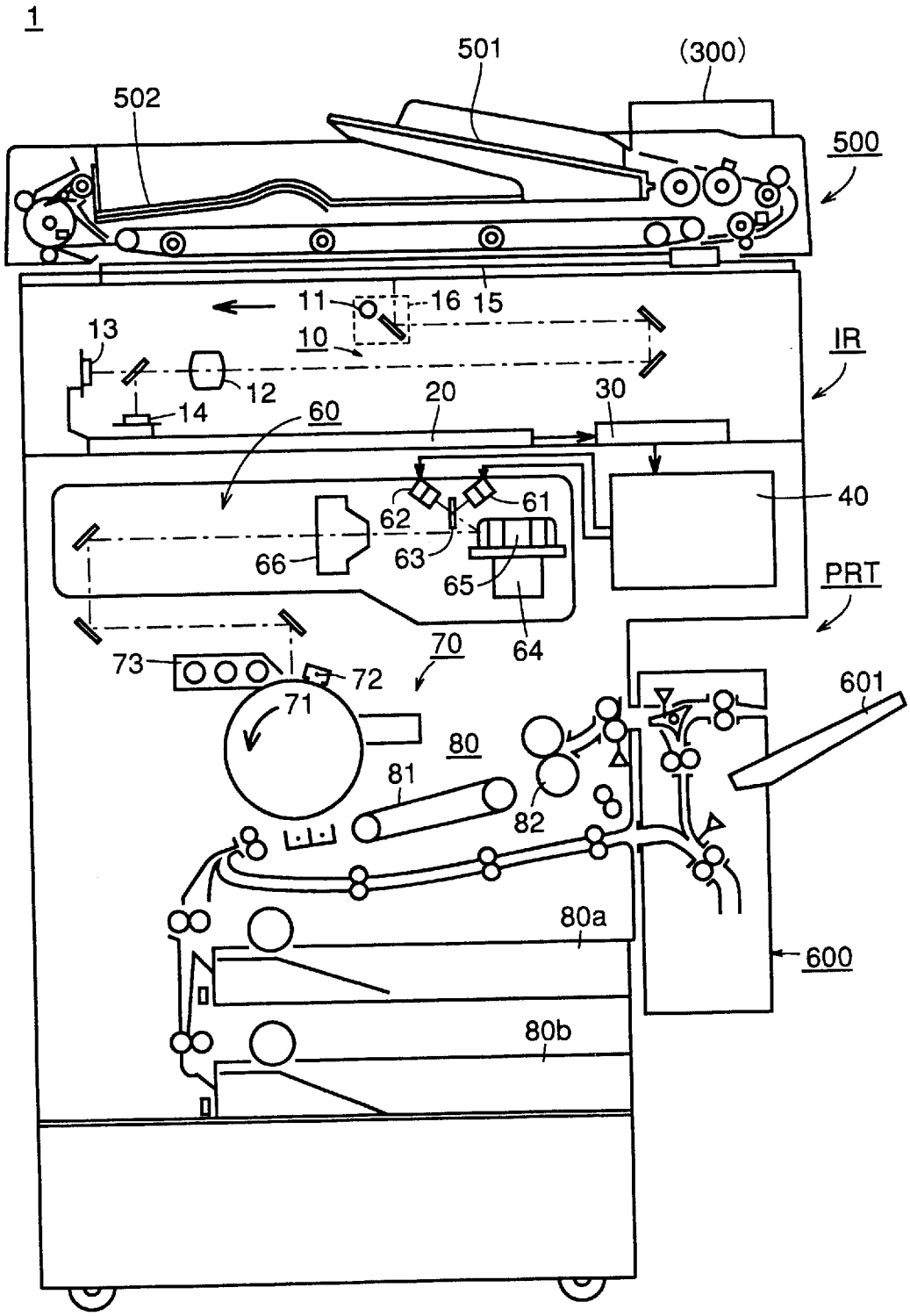
FIG. 1 is a schematic cross sectional view of a structure of a copying machine 1 as one embodiment of the present invention.

Referring to FIG. 1, a copying machine 1 as one example of the present invention is generally configured of a reader device IR for reading an image of an original to generate image data, an image storing unit 30 for temporarily storing the image data obtained at reader device IR, a printer device PRT for printing on a copying sheet based on the image data stored in image storing unit 30, an operation panel 300 provided on the top surface (perpendicular to the plane of the sheet) of copying machine 1 for inputting operations, an original transport unit 500 for transporting an original and turning over the original as required, and a sheet refeeder unit 600 for turning over a finished copying sheet and refeeding it to printer device PRT as required. These operations are controlled by a control unit (not shown), and the configuration and the like of the control unit will be described later.

In original transport unit 500, when printing is instructed, originals set on an original feeding tray are automatically set on an original glass 15 at a reading position successively from the bottom original. When reader device IR completes reading, the originals are discharged onto a discharging tray 502.

Reader device IR is comprised of a scan system 10 and an image signal processing unit 20. In scan system 10, an image of an original set at the reading position is initially exposed to light by an exposure lamp 11 mounted to a scanner 16 which moves under the image. The reflected light from the original passes through a reflection mirror and a condenser lens 12 and is input to photoelectric conversion elements 13 and 14 which use a CCD array or the like. Then, a signal obtained by scan system 10 is transmitted to image signal processing unit 20 which applies an image processing, such as binarization processing, image quality correction, magnification varying, image editing and the like, to the input signal. The image-processed image data is then stored in image storing unit 30.

Printer device PRT is formed of a printing processing unit 40, an optical system 60, an image forming system 70 and a sheet transport system 80. Printing processing unit 40 drives optical system 60 according to the image data from image storing unit 30. In optical system 60, semiconductor lasers 61 and 62 emit laser beams according to a signal controlled by printing processing unit 40. These beams are synthesized by a dichroic mirror 63. The synthesized beam is reflected by a polygon mirror 65 which is rotated by a motor 64, passes through a main lens 66 and irradiates a photoreceptor 71 of image forming system 70.

In image forming system 70, photoreceptor 71 is first charged by a corona charger 72 and then irradiated with the laser beam from optical system 60. This allows an electrostatic latent image to be formed on photoreceptor 71. Then, a developing device 73 places toner onto the electrostatic latent image. The toner image on photoreceptor 71 is transferred onto a copying sheet fed from a sheet feeding cassette 80*a* or 80*b* of sheet transport system 80. Then, a sheet transport belt 81 transports the sheet to a fixer 82, the toner is fixed onto the sheet through heat and pressure and then the sheet is discharged onto discharging tray 601 of sheet refeeder unit 600.

During these operations in copying machine 1, an error, such as sheet jamming, can be detected in original transport unit 500 and printer device PRT. Furthermore, an error, such as sheet shortage in sheet feeding cassettes 80*a* and 80*b*, can be detected in printer device PRT, and an error, such as inappropriate setting of an original at the reading position, can be detected in original transport unit 500. It can also be detected when copying machine 1 stops operating due to a failure or the like. Furthermore, although it is not shown, copying machine 1 has a magnetic card reader and thus a magnetic card can be used to identify a user as required.

Figure 2:
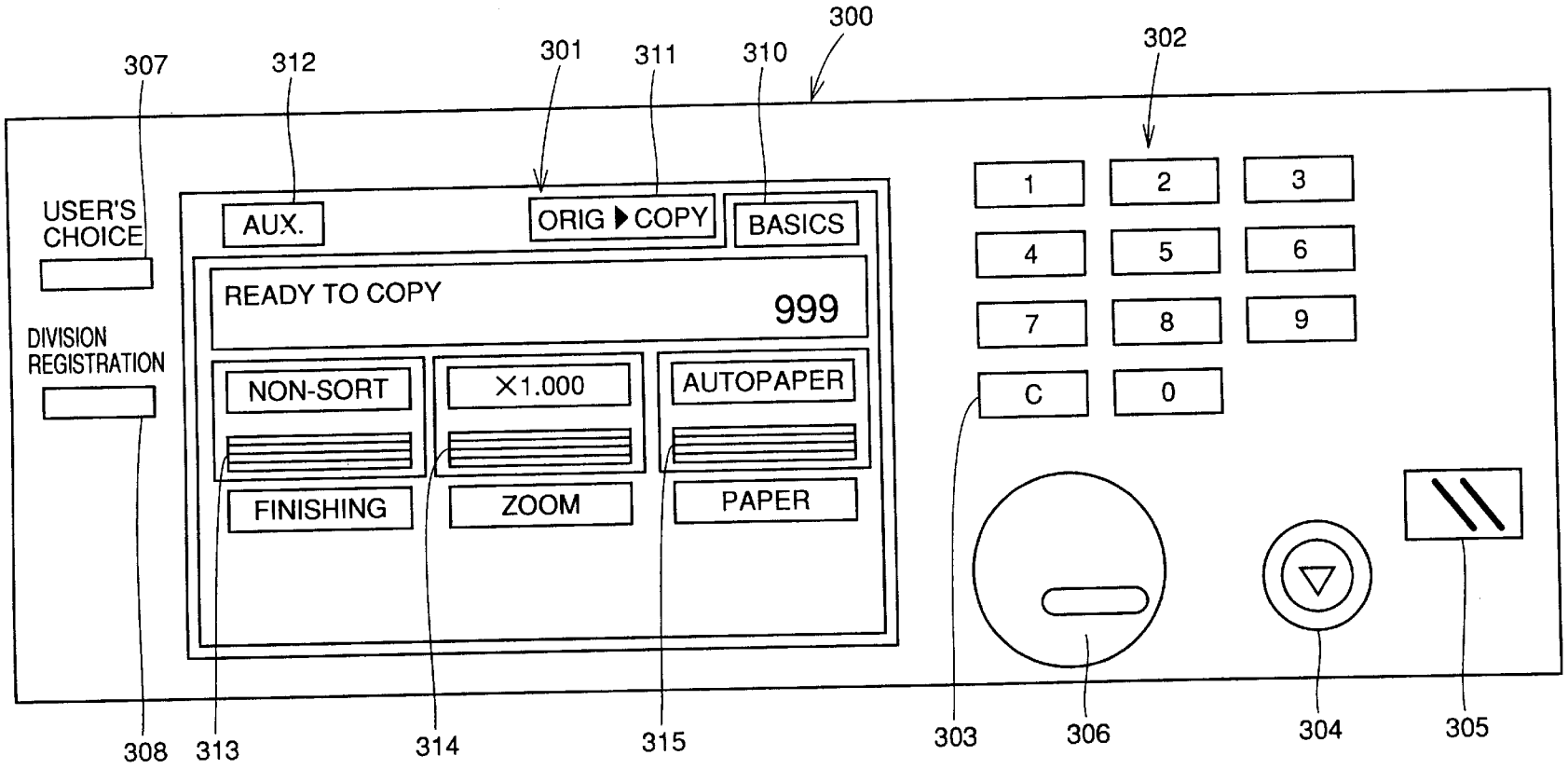
FIG. 2 is a plan view of a configuration of an operation panel.

FIG. 2 is a plan view of a configuration of operation panel 300.

A displaying portion 301 on operation panel 300 displays a basic screen. The basic screen is the screen displayed immediately after power-on or when the panel is reset, and displays touch keys 310, 311 and 312 for selecting the three main items "Basics", "Original→Copy" and "Auxiliary Function", and touch keys 313, 314 and 315 for selecting the subitems "Finishing", "Zoom" and "Paper" when the "Basic" item is selected.

A ten-key 302 is used for inputting numerical values for e.g., the number of sheets for copying, copying magnification and the like, and a clear key 303 is used for clearing a numerical value input via ten-key 302. A start key 306 is used for starting a copying operation, and a stop key 304 is used for stopping a copying operation being performed. A panel reset key 305 is used for resetting to the initial condition a copying condition set by an operation for a setting screen displayed on displaying portion 301. A User's Choice key 307 is used when a user sets the User's Choice data for each division, and a division registration key 308 is used when a user registers a new division.

Figure 3:
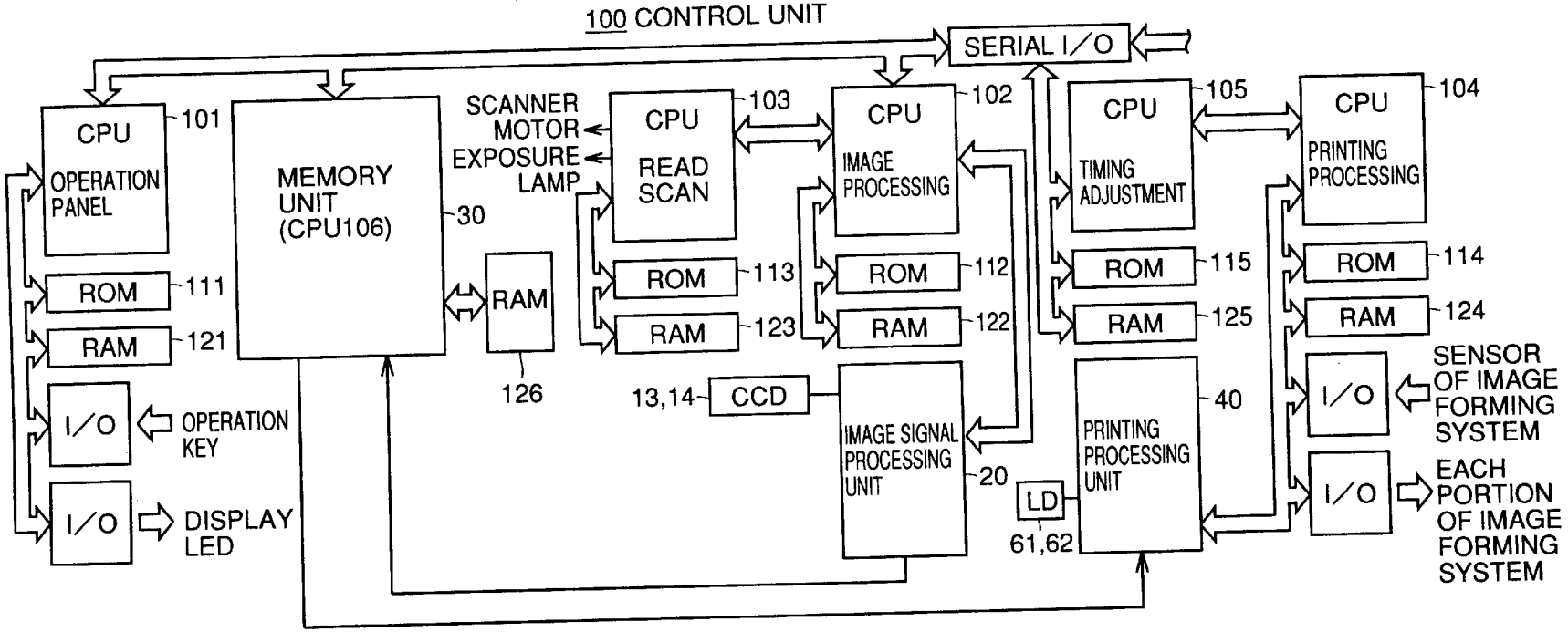
FIG. 3 is a first block diagram for illustrating a configuration of a control unit of copying machine 1.
Figure 4:
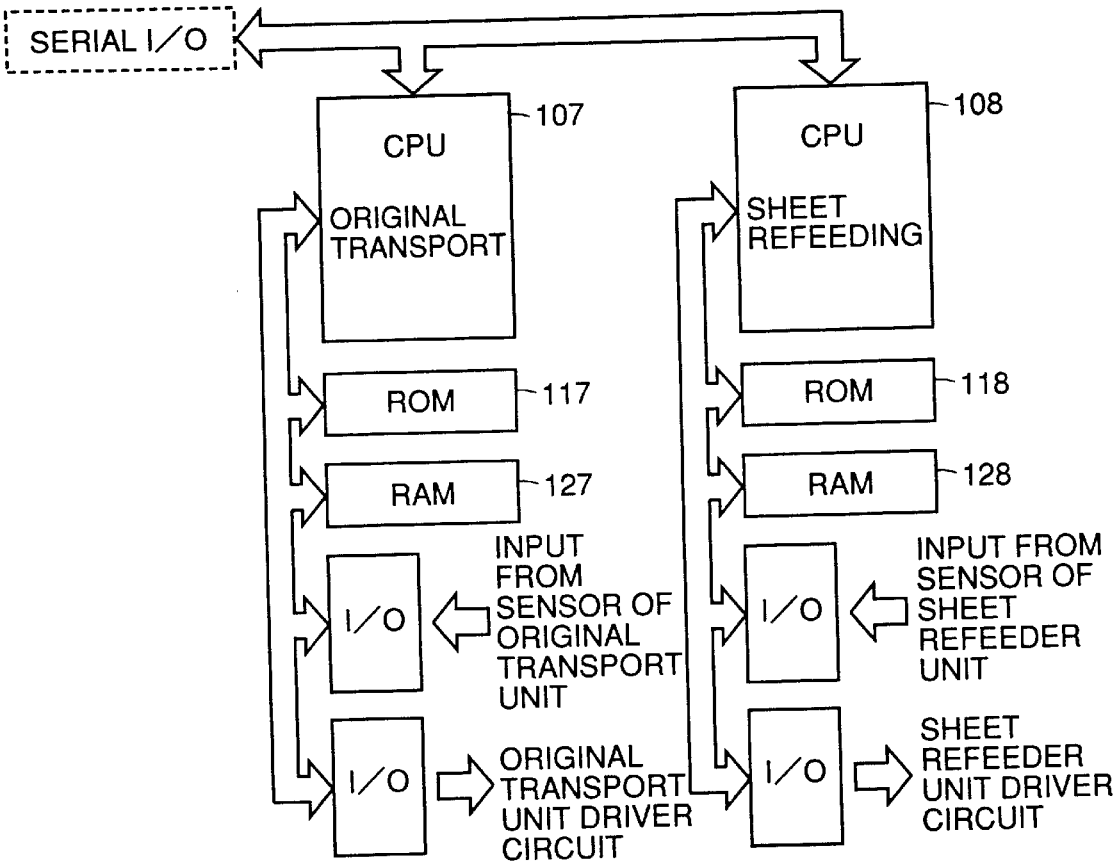
FIG. 4 is a second block diagram for illustrating a configuration of the control unit of copying machine 1.

A control unit 100 will now be described. FIGS. 3 and 4 are block diagrams for illustrating a configuration of control unit 100 of copying machine 1.

Control unit 100 is mainly configured of eight CPUs 101–108 which are provided with ROMs 111–118 each for storing a program and RAMs 121–128 each as a working area for program execution. CPU 106 is provided in image storing unit 30.

CPU 101 provides control related to inputting and displaying of signals from various operation keys of operation panel 300. CPU 102 controls portions of image signal processing unit 20. CPU 103 controls driving of scan system 10. CPU 104 controls printing processing unit 40, optical system 60 and image forming system 70. CPU 105 provides a processing for general timing adjustment of control unit 100, operating mode setting and the like.

CPU 106 controls image storing unit 30 to first store read image data into a memory and then read and output it to printing processing unit 40. This allows reader device IR and printer device PRT to be controlled independently of each other so that copying speed is improved.

CPU 107 controls original transport unit 500 and CPU 108 controls sheet refeeder unit 600. Serial communication with interruption is performed among CPUs 101–108 for transmitting and receiving data.

Referring to the flow charts, a procedure of a control performed by CPU 101 particularly related to the present invention will now be schematically described.

Figure 5:
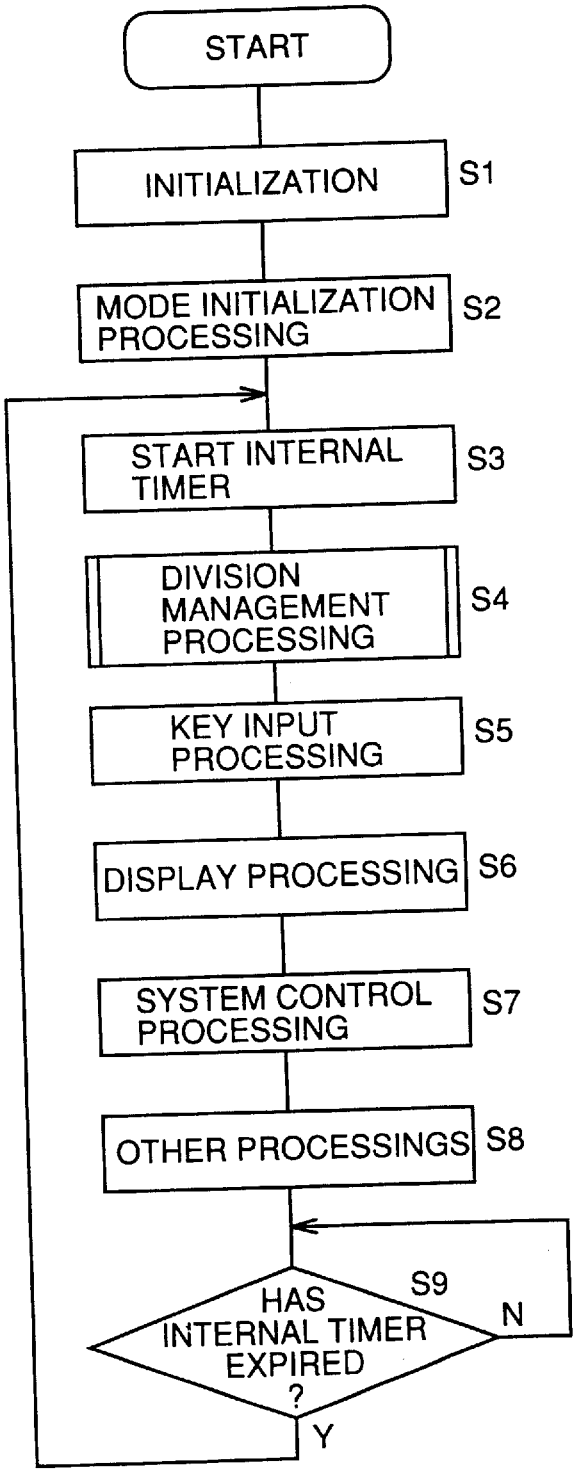
FIG. 5 is a flow chart of a main routine illustrating a procedure of a control performed by a control unit.

FIG. 5 is a flow chart of a main routine illustrating the procedure of the control performed by CPU 101.

When copying machine 1 is powered on and CPU 101 is reset, a program is started. First, CPU initialization, such as clearing of RAM, setting of various registers and the like, is performed at step 1 (hereinafter, step will be abbreviated as S), a processing for initializing the mode of copying machine 1 is performed at S2, and an internal timer incorporated in CPU 101 is started at S3. The value counted by the internal timer is defined to have the length of one routine the value of which is preset in the initialization at S1.

Then, a processing for managing divisions is performed at S4. A plurality of divisions can be set. Use's Choice data as an operating environment for copying machine 1 is set for each of the divisions. The data for the User's Choice is stored in RAM 121 which accompanies CPU 101 and is backed up by a battery, although the data may be stored in an appropriate back-up memory, hard disc or the like. An operating environment can thus be set for each division to conveniently use the copying machine.

The division management processing is performed in a subroutine which will be described later.

The items which can be set as User's Choice options will now be described. FIG. 12A shows exemplary functions which can be set through the User's Choice. As shown in FIG. 12A, functions such as "setting priority as to original→copy mode", "setting of the language for displaying messages", setting priority as to whether or not originals are mixed", "setting as to whether or not data reading is allowed after the last sheet is discharged", "setting priority among AutoSheet/AutoZoom/Manual", "setting priority as to sheet feeding source" and the like can be set through the User's Choice.

FIGS. 12B–12G describe each function mentioned above. In each item, the setting which is marked by a circle in the column of "initial value" indicates the User's Choice value UCH-0 of the system described later.

Figure 13A:
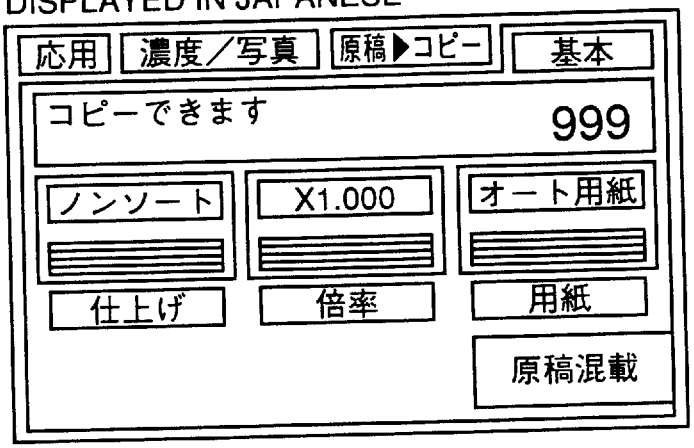
FIGS. 13A and 13B show screens displayed on the operation panel in various languages.
Figure 13B:
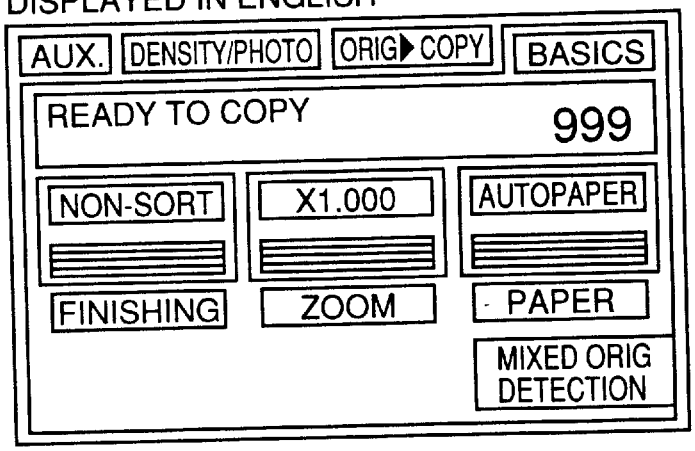

The initial value is a value for the initial mode when the panel is reset. That is, the operation panel displays the mode set by the initial value. When the language selection shown in FIG. 12C is switched, the language for display on the operation panel can be switched as shown in FIGS. 13A and 13B.

Referring again to the flow chart shown in FIG. 5, S5 provides a processing of a key input via hard and touch keys on operation panel 300, and S6 provides a processing for the display corresponding to the key input. S7 provides a system control processing for controlling the normal operation of copying machine 1 and S8 provides other processings successively.

After the processings at S3–S8 are performed, it is determined at S9 whether the internal timer set at S2 has expired. If the internal timer has expired (YES at S9), one routine is ended and the processing returns to S3. If the internal timer has not yet expired (NO at S9), the processing stays at S9 and waits until the internal timer expires.

Figure 6:
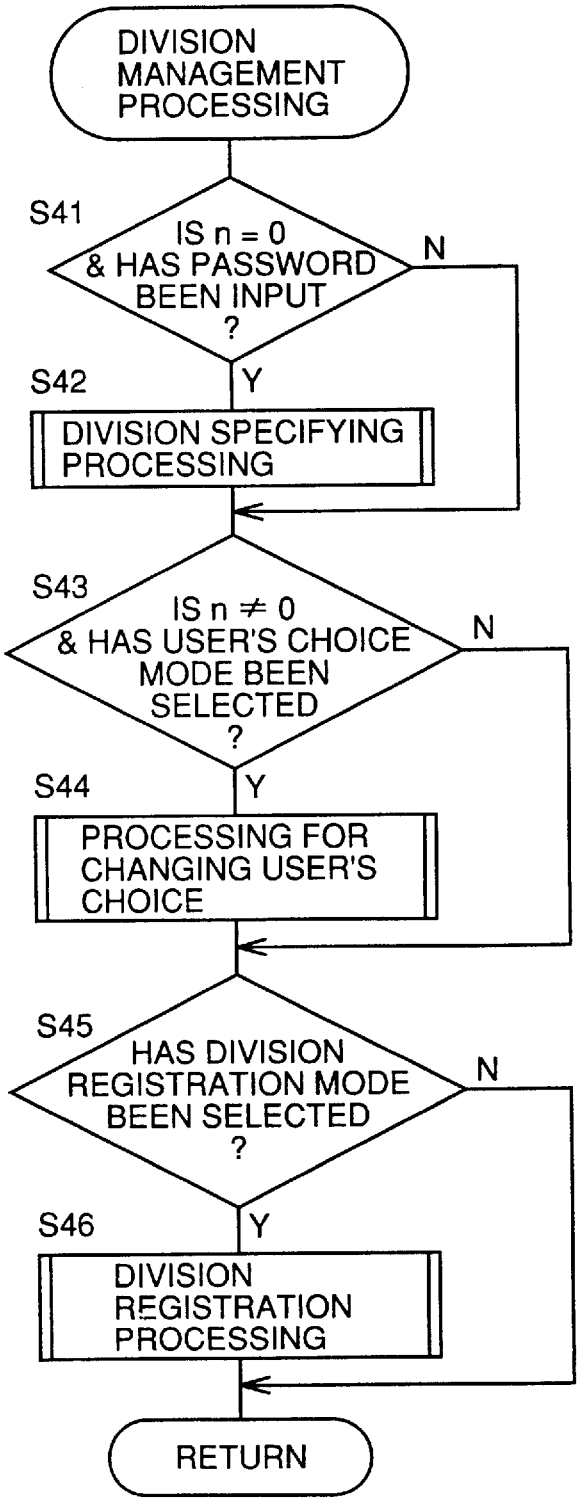
FIG. 6 is a flow chart of a subroutine of a division management processing at S4 in FIG. 5.

FIG. 6 is a flow chart of a subroutine of the division management processing at S4 shown in FIG. 5. It is assumed that a division number n which indicates division type is set at 0 in initialization, and that number other than 0 which corresponds to a division is set when a user selects the division at S42. The User's Choice mode and the division registration mode are selected when a user presses a User's Choice key 307 and a division registration key 308 shown in FIG. 2, respectively.

First, it is determined at S41 whether "division number n is 0 and a password has been input." When "division number n is 0 and a password has been input" (YES at S41), S42 provides a processing for specifying division type to specify a division based on the password input by a user and the value of the data for the User's Choice (referred to as a User's Choice value hereinafter) is set at the value of the division specified according to the password. When it is not determined that "division number n is 0 and a password has been input" (NO at S41), the division specifying processing at S42 is skipped.

Then, it is determined at S43 whether "division number n is not 0 and the User's Choice mode has been selected." If "division number n is not 0 and the User's Choice mode has been selected" (YES at S43), S44 provides a processing for changing the User's Choice to change and store a User's Choice value as required by a user. If it is not determined that "division number n is not 0 and the User's Choice mode has been selected" (NO at S43), the processing for changing the User's Choice at S44 is skipped.

A changing processing will now be described. Division number n is set to 0 when:

(a) division number n is not 0 and a password is input;

(b) autoclear is set; or (c) the power supply is turned on.

Figure 10B:
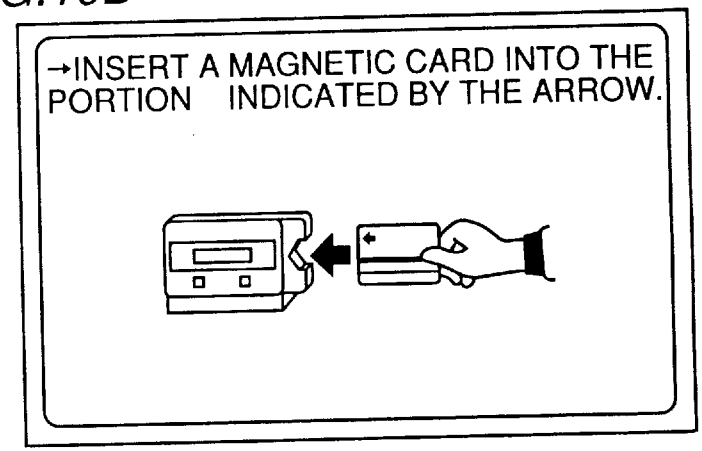
FIGS. 10A–10D show indications on a display portion from the time when the division management function is selected to the time when a normal User's Choice value is set.
Figure 10D:
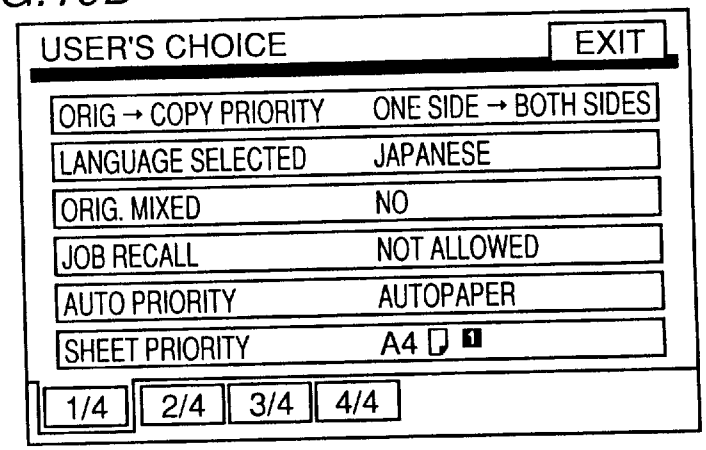
Figure 10A:
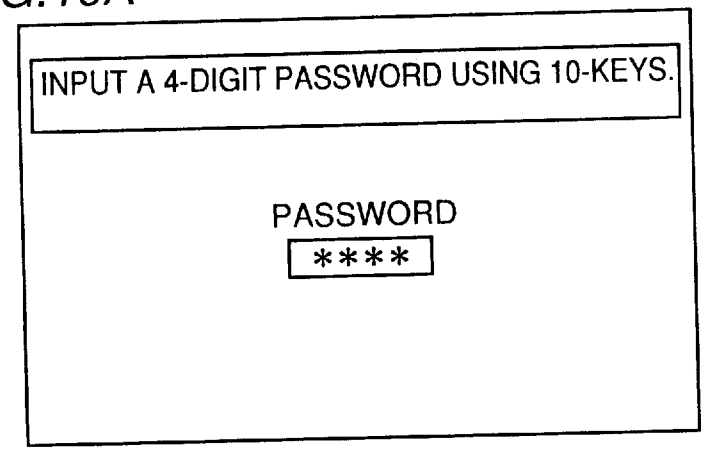

It should be noted that division number n=0 when no division number n is input, i.e., in the states shown in FIGS. 10A and 10B.

The timing at which division number n is set to a number other than 0 will now be described. It indicates that the current managed division has been determined. Division number n is set to a number other than 0 when:

(d) a registered password is input on a screen for inputting passwords and the division number corresponding to the password is thereby generated as internal data; or (e) a magnetic card with a registered division number is inserted into a magnetic card reader and the division number is inserted into a magnetic card reader and the division number is thereby generated as internal data.

It should be noted that the internal data is used to specify the data for choice of storage or access and also to specify the location for counting in division management.

Referring again to the flow chart shown in FIG. 6, it is determined at S45 whether the division registration mode has been selected. If the division registration mode has been selected (YES at S45), S46 provides the division registration processing to register a new division, as required by a user, and then the routine returns. If the division registration mode has not been selected (NO at S45), the division registration processing at S46 is skipped and the routine returns.

Figure 7:
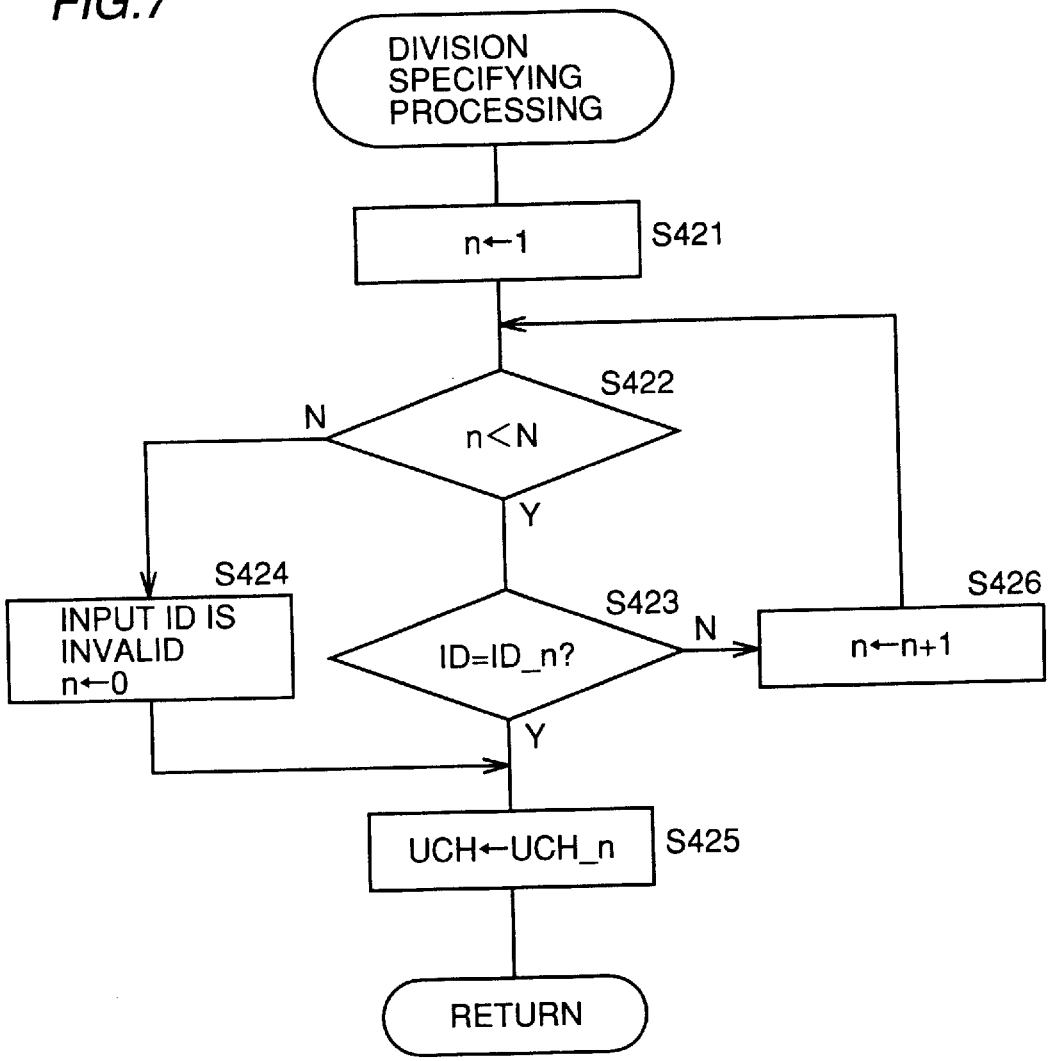
FIG. 7 is a flow chart of a subroutine of a division specifying processing.
Figure 8:
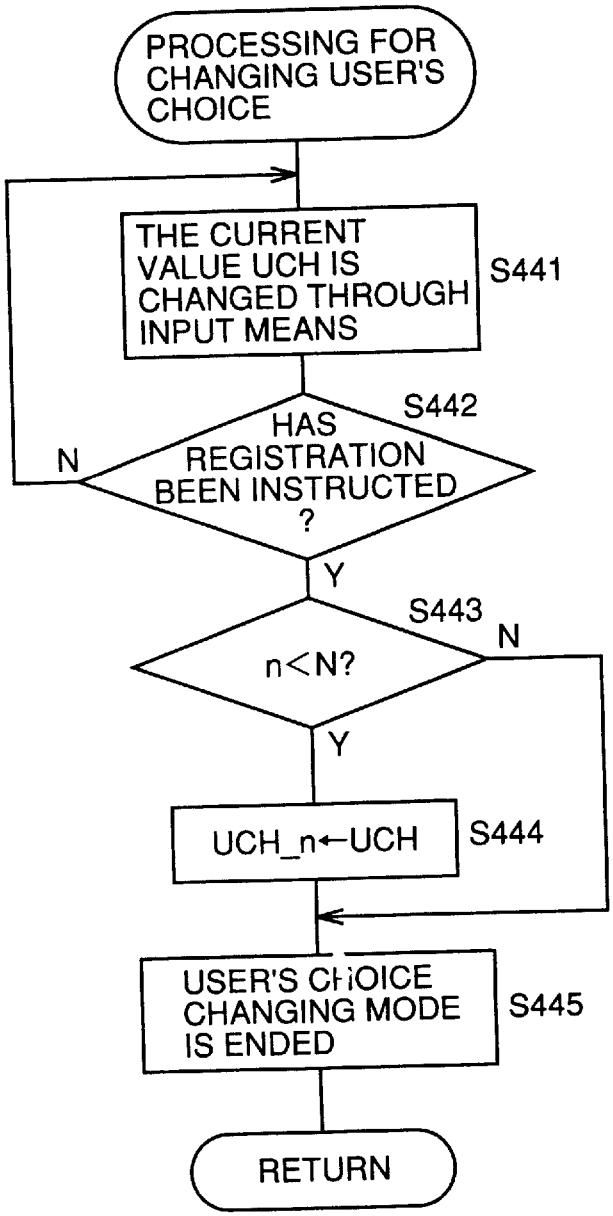
FIG. 8 is a flow chart of a subroutine for processing for changing a User's Choice at S44 in FIG. 6.
Figure 9:
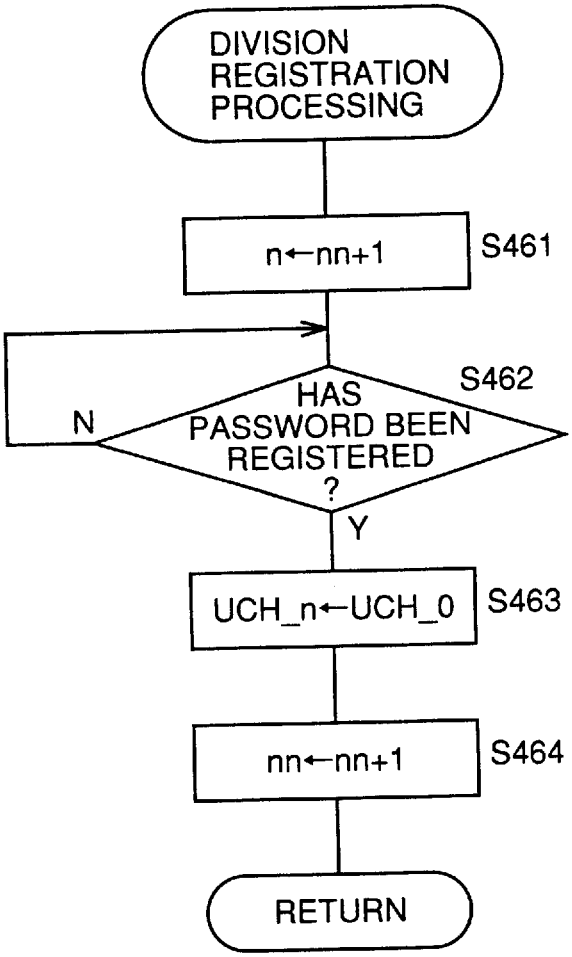
FIG. 9 is a flow chart of a subroutine of a division registration processing at S46 in FIG. 6.

The division registration processing at S42, the User's Choice changing processing at S44, and the division registration processing at S46 are performed in the subroutines described with references to FIGS. 7–9.

FIG. 7 is a flow chart of a subroutine of the division specifying processing at S42 shown in FIG. 6.

First, division number n as an internal management number which indicates division type is substituted with 1 at S421. It is determined at S422 whether the division number n is larger than the maximum number N of divisions registered.

When the division number n is smaller than the maximum number N of divisions registered (YES at S422), it is determined at S423 whether an input password ID is equal to the password ID_n of the division n. If the input password ID is equal to the password ID_n of the division n (YES at S423), the processing is shifted to S425. If input password ID is not equal to the password ID_n of the division n (NO at S423), the division number n is incremented by one at S426 and then the processing is shifted to S422.

If the division number n is not smaller than the maximum number N of divisions registered (NO at S422), the input password ID is invalidated and n is substituted by 0 at S424 and the processing is shifted to S425.

Then, at S425, the User's Choice value UCH_n of the division n is set as the current User's Choice value UCH and the routine ends.

When an input password ID is invalidated, the User's Choice value UCH_0 of the system is set as the current User's Choice value UCH and the routine ends. It should be noted that the User's Choice value UCH_0 of the system is that User's Choice value stored in a hard disc, a back-up memory or the like which can commonly be used by users independently of divisions and also be arbitrarily rewritten by a specific user (e.g., a manager of the device) through such a processing as shown at S42 as described below.

A User's Choice value UCH_n thus set according to the division specified by a password input by a user is set as the User's Choice value UCH which determines the current operating environment for copying machine 1.

FIG. 8 is a flow chart of a subroutine of the User's Choice changing processing at S44 shown in FIG. 6.

First, a user operates operation panel 300 (shown in FIG. 2) at S441 to change the current User's Choice value UCH. It is determined at S442 whether there is an instruction to register the User's Choice value UCH changed at S441. If there is not an instruction (NO at S442), the processing is returned to S441. If there is an instruction (YES at S442), the processing is shifted to S443.

Then, it is determined at S443 whether division number n is smaller than the maximum number N of divisions registered. If division number n is smaller than the maximum number n of divisions registered (YES at S443), the current User's Choice value UCH, which has been changed by the user, is set as the User's Choice value of division n at S444. If division number n is not smaller than the maximum number N of divisions registered (NO at S443), the processing at S444 is skipped.

Then, at S445, the User's Choice changing mode ends and the processing associated therewith is performed, and the routine is completed.

Thus, a user changes the current User's Choice value UCH, which is registered as the User's Choice value UCH_n of division n. Changing and registering a User's Choice value UCH includes changing and registering the User's Choice value UCH_0 of the system for n=0.

FIG. 9 is a flow chart of a subroutine of the division registration processing at S46 shown in FIG. 6.

First, at S461, division number n is substituted with the number nn of the currently registered divisions plus one. At S462, a user inputs a password and it is determined whether registration of the password is completed. If the registration of the password has not yet been completed (NO at S462), the password is continuously input at S462. If registration of the password has been completed (YES at S462), the User's Choice value UCH_0 of the system is set as the default User's Choice value UCH_n of the division n at S463. Then, at S464, the number nn of the currently registered divisions is incremented by one and the routine is completed.

Thus, in registering a new division, the User's Choice value UCH_0 is set as the User's Choice value UCH_n of the new division n.

Thus, the User's Choice changing processing shown in FIG. 8 is performed so that a specific user can change and store the User's Choice value UCH_0 of the system. Furthermore, the division registration processing shown in FIG. 9 is performed to set the User's Choice value UCH_0 of the system as the User's Choice value UCH_n of an additionally registered division n.

Along with the control described above, the screens shown in FIGS. 10A–10D and 11A–11D are then displayed on display portion 301 (shown in FIG. 2) of operation panel 300.

Figure 10C:
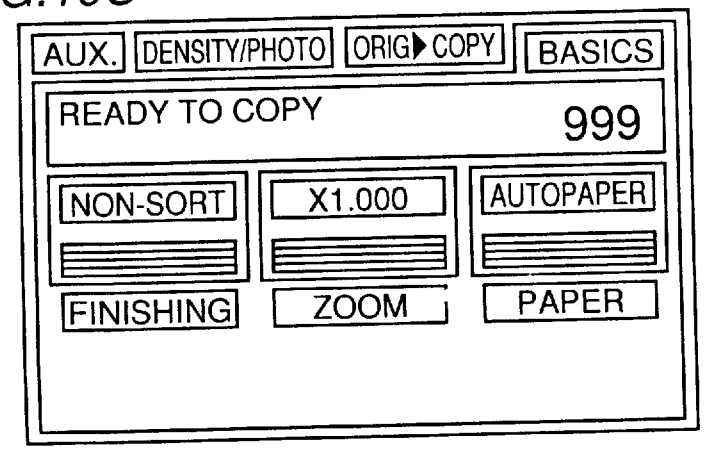

FIGS. 10A–10D show screens displayed on display portion 301 from the time when the division management function is selected until the normal User's Choice value is set. FIG. 10A shows a screen for providing an instruction to input a password. FIG. 10B shows a screen for providing an instruction to insert a magnetic card into the magnetic card reader. FIG. 10C shows a screen when copying is performed according to a designated division. FIG. 10D shows a screen in setting a User's Choice.

When the division management function is selected, a password is input (FIG. 10A) or a magnetic card is inserted (FIG. 10B) to specify a division. When a user inputs a password or inserts a magnetic card and a division is specified, the user can make a copy in an operating environment corresponding to a User's Choice value which is preset for the specified division (FIG. 10C). The user can select a User's Choice as required to set that operating environment for copying machine 1 which corresponds to a division (FIG. 10D).

As shown in FIG. 10D, the items which can be selected as User's Choice options are: whether an original has one side or the both sides printed and whether copying is provided on one side or the both sides of a sheet; which language is used for displaying a message; whether a copy is made with or without originals mixed; whether job recall is performed; and the like.

Figure 11A:
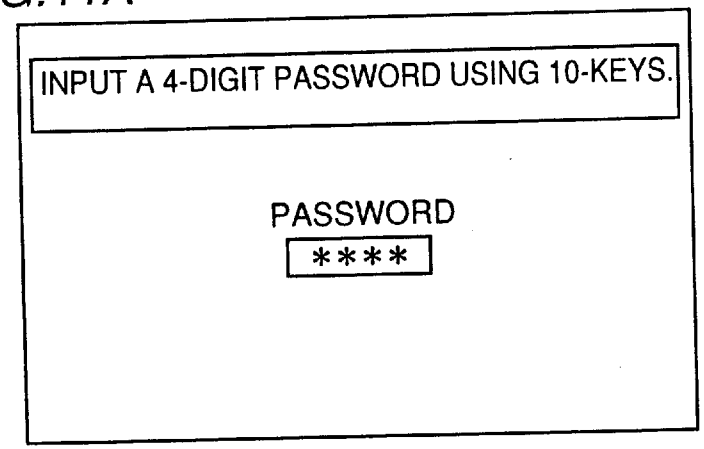
FIGS. 11A–11D show indications on the display portion from the time when the division management function is selected to the time when a User's Choice value of the system is set.
Figure 11B:
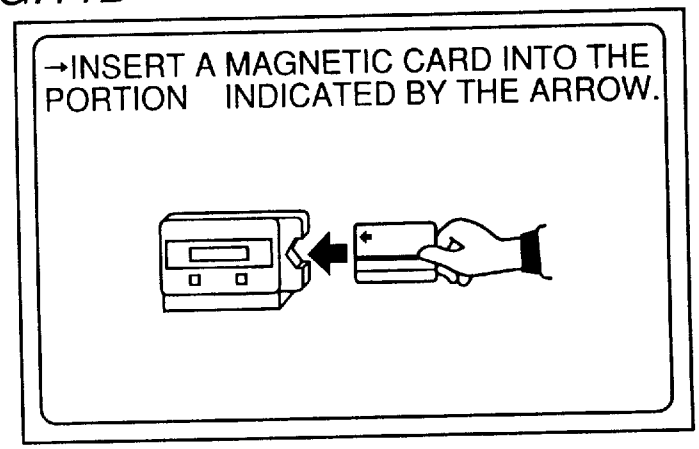
Figure 11C:
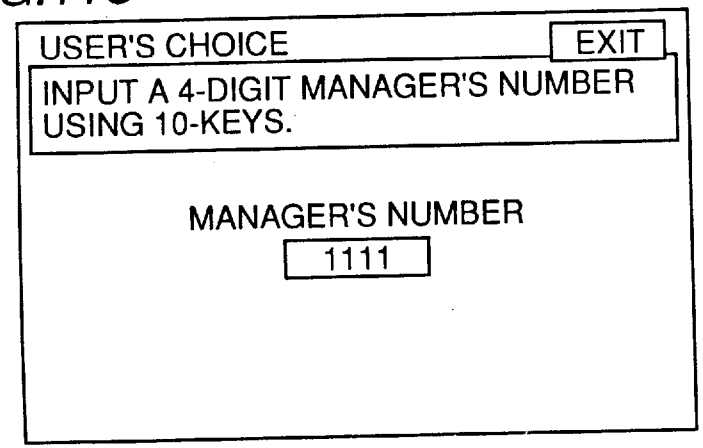
Figure 11D:
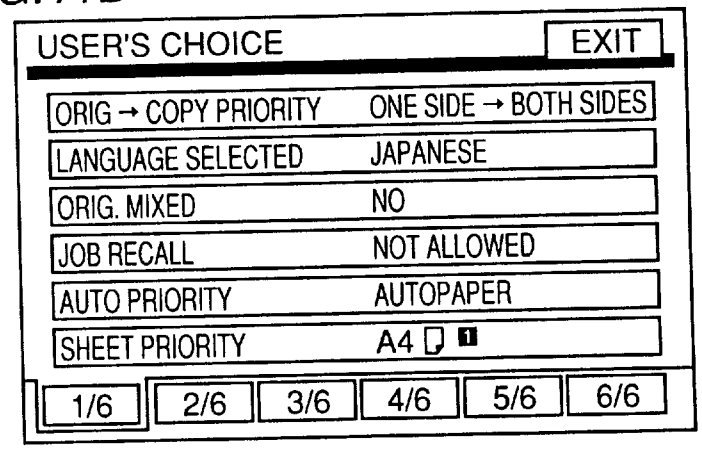

FIGS. 11A–11D show screens displayed on display portion 301 from the time when the division management function is selected until the User's Choice value of the system is set. FIG. 11A shows a screen for providing an instruction to input a password. FIG. 11B shows a screen for providing an instruction to insert a magnetic card. FIG. 11C shows a screen for providing an instruction to input a password of a manager of a division. FIG. 11D shows a screen in setting the User's Choice of the system.

Figure 14A:
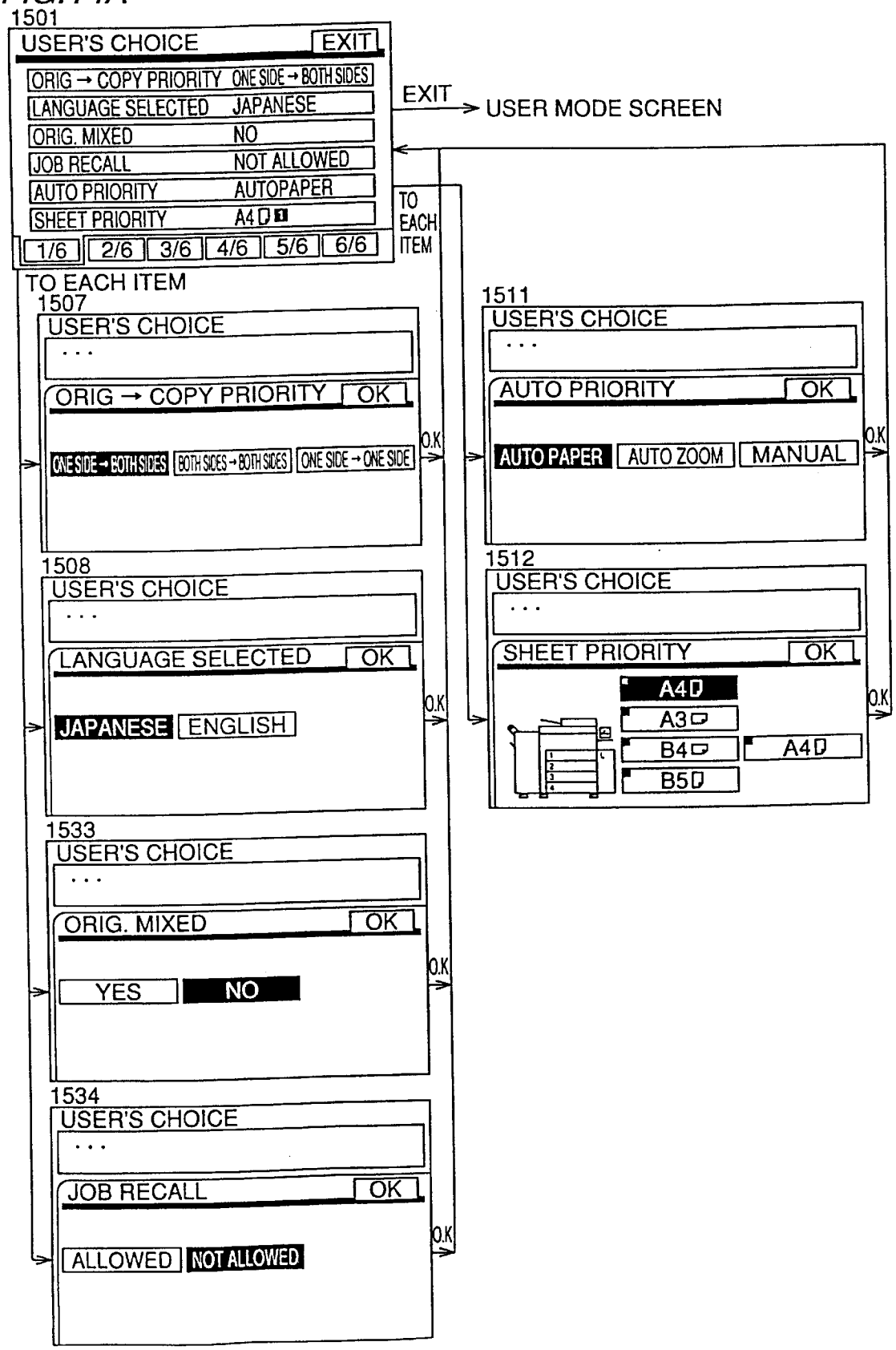
FIGS. 14A and 14B show a transition in the User's Choice screen on the display.
Figure 14B:
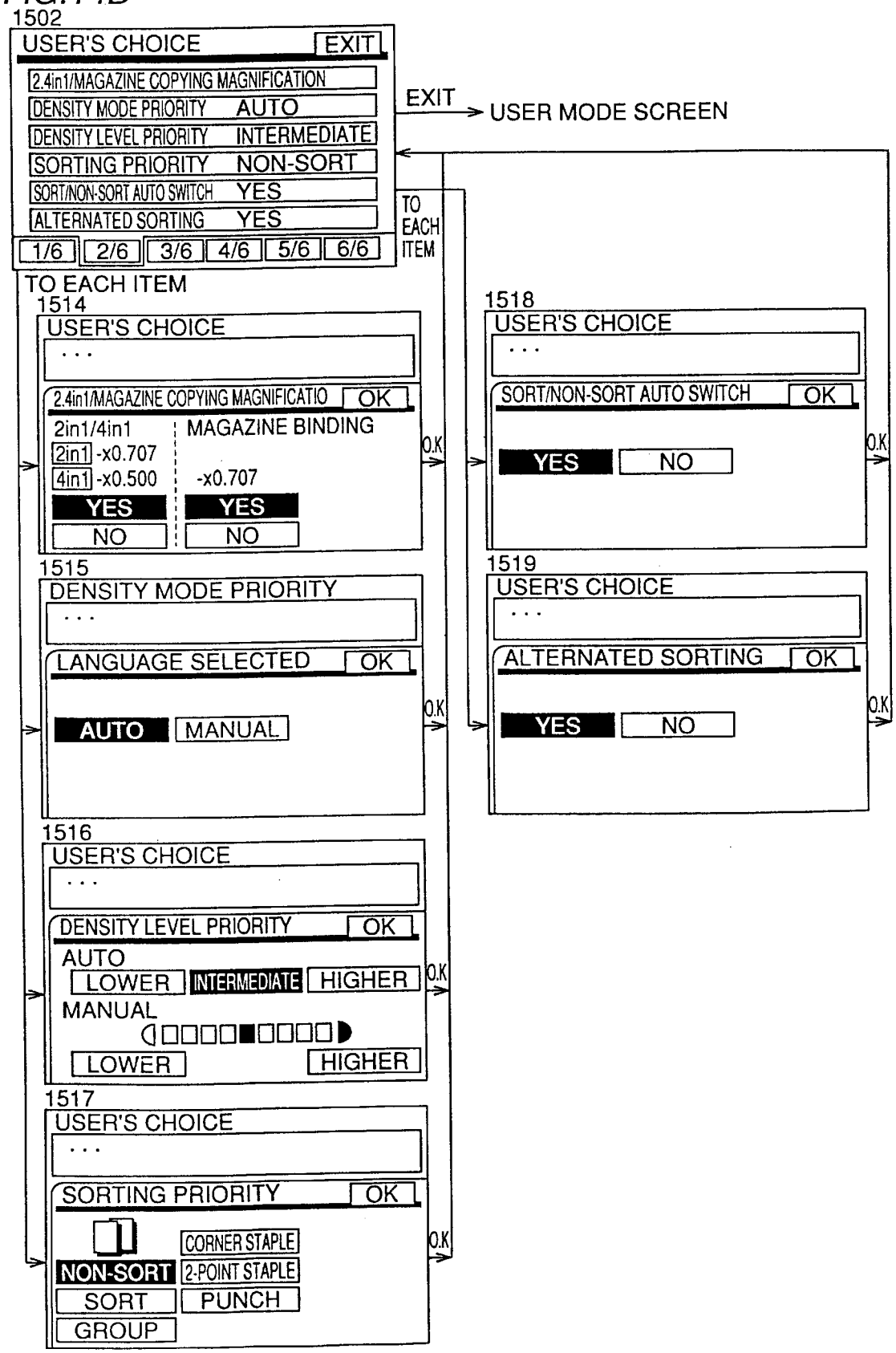

When the division management function is selected, a request is made to input a password (FIG. 11A) or to insert a magnetic card (FIG. 11B) and the user is thus requested to designate a division. When the user selects the User's Choice without responding to the request, the user is again requested to input a password (FIG. 11C). When the user inputs the password of a manager of a division, a screen is displayed for setting the User's Choice value of the system (FIG. 11D). When each item key is pressed on the User's Choice screen shown in FIG. 11D, a setting screen for each item is displayed. The setting screens are shown in FIGS. 14A and 14B. When a password is not input and a magnetic card is not inserted and thus a division is not designated, copying machine 1 operates in an operating environment according to the User's Choice value of the system.

Since the User's Choice value of the system that can be changed and stored is thus set as the default User's Choice value of an additionally set division, it is not necessary for users to conventionally set new User's Choice values based on the User's Choice value of the system that is stored in a ROM and thus cannot be changed. It is thus not cumbersome for users to set new User's Choice values and thus the users can readily set User's Choice values for additionally set divisions.

As illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

an image forming device for forming an image in a plurality of operating environments:

a first storing device for storing information on a user;

a first input device for inputting information on a user;

a second storing device for storing an initial operating environment and an operating environment corresponding to the information on the user stored in said first storing device;

a device for changing said operating environment;

a second input device for inputting a change in said operating environment to said device for changing;

a device for specifying a user according to an input from said first input device and to the information on the user; and a device for setting said initial operating environment as an operating environment for said image forming device when a result obtained by said device for specifying is as predetermined.

2. The image forming apparatus according to claim 1, wherein common divisional information shared by a plurality of users and personal information on individual users are input through said first input device.

3. The image forming apparatus according to claim 2, wherein said device for setting sets said initial operating environment as the operating environment for said image forming device when the result obtained by said device for specifying shows that personal information of interest is invalid.

4. The image forming apparatus according to claim 2, wherein said device for setting sets said initial operating environment as the operating environment for said image forming device when the result obtained by said device for specifying shows that personal information of interest has not yet been input.

5. The image forming apparatus according to claim 1, wherein said first input device accepts an input on an operation panel provided in said image forming apparatus.

6. The image forming apparatus according to claim 1, wherein said first input device is an information transmitting medium which stores the information on the user.

7. The image forming apparatus according to claim 6, wherein said information transmitting medium is a magnetic card.

8. An image forming apparatus comprising:

an image forming device for forming an image in a plurality of operating environments;

an input device for inputting information on a user;

a storage for storing an initial operating environment and an operating environment corresponding to input said information on the user;

a device for changing an operating environment stored in said storage;

a device for specifying a user based on an input from said input device; and a device for setting said initial operating environment stored in said storage as an operating environment for said image forming device when a result obtained by said device for specifying is as predetermined.

9. The image forming apparatus according to claim 8, wherein common divisional information shared by a plurality of users and personal information on individual users are input through said input device.

10. The image forming apparatus according to claim 9, wherein said device for setting sets said initial operating environment stored in said storage as the operating environment for said image forming device when the result obtained by said device for specifying shows that personal information of interest is invalid.

11. The image forming apparatus according to claim 9, wherein said device for setting sets said initial operating environment stored in said storage as the operating environment for said image forming device when the result obtained by said device for specifying shows that personal information of interest has not yet been input.

12. The image forming apparatus according to claim 8, wherein said input device accepts an input on an operation panel provided in said image forming apparatus.

13. The image forming apparatus according to claim 8, wherein said input device is an information transmitting medium which stores the information on the user.

14. The image forming apparatus according to claim 13, wherein said information transmitting medium is a magnetic card.

* * * * *